United States Patent [19]

Dyer

[11] Patent Number: 5,007,871

[45] Date of Patent: Apr. 16, 1991

[54] DIVE-PLANE

[76] Inventor: William R. Dyer, 4517 126th St. SE., Everett, Wash. 98208

[21] Appl. No.: 387,588

[22] Filed: Jul. 31, 1989

[51] Int. Cl.[5] ..... A63C 15/00

[52] U.S. Cl. ..... 441/65; 441/79

[58] Field of Search ..... 441/65, 66, 67, 68, 441/69; 114/66, 253

[56] References Cited

U.S. PATENT DOCUMENTS

| | | | |
|---|---|---|---|
| 2,948,251 | 8/1960 | Replogle | 441/65 |
| 3,139,055 | 6/1964 | Nutting | 441/65 |
| 3,237,222 | 3/1966 | Frost | 441/65 |
| 3,931,777 | 1/1976 | Colgan | 441/65 |
| 4,437,842 | 3/1984 | Conner | 441/65 |

*Primary Examiner*—Sherman Basinger
*Assistant Examiner*—Stephen P. Avila

[57] ABSTRACT

An aquatic "dive-plane" which operates in tow behind a motorcraft. Used in conjunction with basic snorkle gear it permits the user, by the flexing up or down of peripheral wings to submerge and explore under the surface as well as to turn, maneuver and resurface intermittently for air. It comprises a body of buoyant material to float the unit for easy recovery; a pair of semi-parabolic structures of a rigid, durable transparent material which serve hydrodynamically to minimize drag and to protect the face and mask from turbulence while allowing the user a maximum view of surroundings both above and below the surface; a pair of peripheral wings manually controlled by affixed handles by which the user controls his position in the water; a pair of arm-supports by which the user stabilizes his position in relation to the dive-plane and by which an even distribution or shifting of the pulling tension is permitted.

7 Claims, 1 Drawing Sheet

DIVE-PLANE

The following description relates to an aquatic dive-plane which is used in conjunction with standard snorkel gear to permit users an expedient means to underwater search and exploration.

The object of the invention is to provide an accesible, economical means to underwater exploration, of lake, streams, reefs or any shallow off-shore areas, requiring minimal technical knowledge and equipment. The aquatic dive-plane was conceived for sport and recreation as well as any in the marine industry that may necessitate a fast, thorough search or survey.

In order that the invention may be readily carried into effect, it is described as follows with reference to the accompanying drawing in which.

Figure 1:
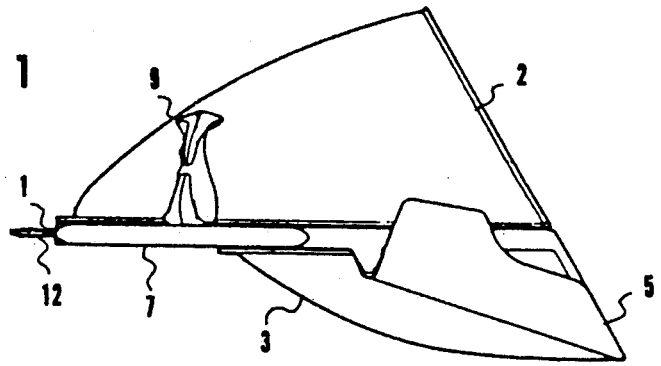
FIG. 1 is a left-side view of the invention
Figure 2:
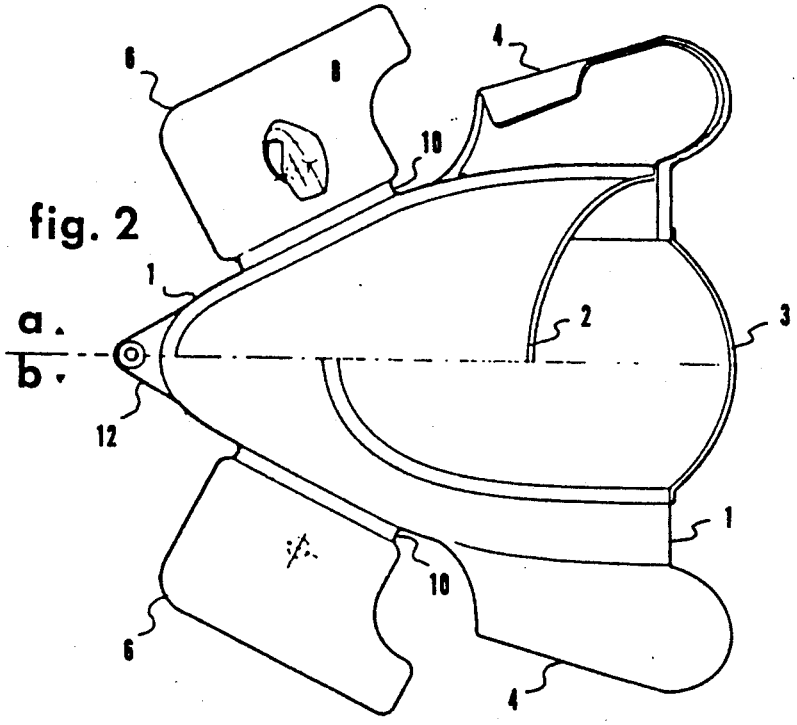
FIG. 2 is a top and bottom view, a and b respectively, of the right side of FIG. 1.
Figure 3:
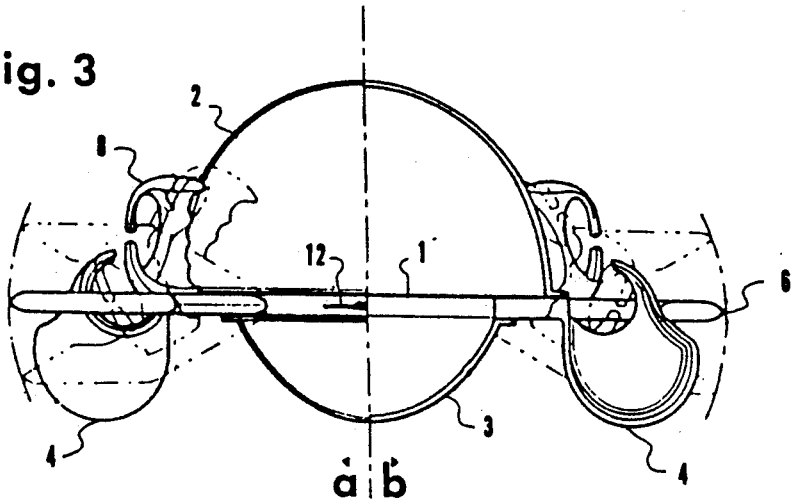

FIG. 3. is a front and rear view, a and b respectively, of the right side of FIG. 1

In all FIGS. like components are identified with like reference numbers.

The invention provides the user an expedient means to underwater exploration and comprises a body 1 of any single suitable rigid buoyant material such, as, for example, foamed plastic, fiberglass or the like and serves to support removably mounted fairings, 2 and 3, of a suitably rigid, transparent, scratch/impact resistant material such as, for example, polypropylene plasic and serving hydrodynamically to minimize drag and water turbulence on the face and mask while permitting the user maximum visibility of surroundings both above and below the waters surface.

A pair of arm-supports 4 and 5 are affixed to the body 1 and are of a suitable rigid material such as, for example, plastic and serve to stabilize the position of the user in relation to the unit and to alleviate fatigue through the distribution and/or shifting, between arm-supports 4 and 5 and handles 8 and 9, of the pulling tension. They are formed so as to permit an unhindered release of the unit when so desired.

A pair of peripheral wings 6 and 7 of any suitable rigid buoyant material such as, for example, plastic foam together with removably affixed handles 8 and 9 serve to permit the user to manually control his position below as well as above the surface i.e. to dive, turn, spiral or resurface. Handles 8 and 9 may be of any suitably high-grip material such as, for example, synthetic rubber.

Wings 6 and 7 are affixed to the body 1 by common hinges 10 and 11 of any suitable rigid yet flexible material such as, for example, polycarbonate plastic with a "memory" which allows the wings 6 and 7 to be flexed while returning to the original, horizontal position when at rest or when released.

A flexing eyelet 12, by which a tow-line and swivel may be attached between the user and the motorcraft, permits a smooth response to manual maneuvers.

The dive-plane link to surface control, that is the towing motorcraft and its operator, facilitate if desired a thorough and systematic search of survey of a given area in a body of water. By folowing a grid pattern a thorough search can be conducted more quickly an less exepensively than conventional means to date.

Its function includes, yet is not limited to, simple random exploration for pleasure as well aw more specific search and recovery of missing objects or persons.

A buoyant material is used for the body of the unit to expedite the recovery of the unit and to signal to the motorcraft operator that there is a "diver down" or that the unit has been released.

Although the invention is described herein by means of a specific embodiment I do not intend to limited thereto, as obvious modifications will occur to others in the relative field without departing from the general essence and scope intended.

I claim:

1. An aquatic dive plane device for under water search and exploration, comprising:

(a) a body of buoyant plastic material to float said dive plane device, said body being shaped such that it has a generally pointed, closed front end and rearwardly extending, spaced apart side portions having both inside and outside edges, said side portions being of predetermined length and defining an open operator area therebetween and rearwardly of said front end, (b) arm support means attached to each of said side portions on the outside edge thereof, (c) a wing member made of buoyant plastic material affixed to the outer edge of each side portion forwardly of said arm support means, said wing members having top and bottom surfaces and being affixed along said outer edge by hinge means for limited up and down movement, (d) handle means detachable secured to the top surface of each of said wing members to be grasped by the operator for control of said wing members and said dive plane device and (e) Upper an lower semi-parabolic transparent fairing means removably attached to said body.

2. The aquatic dive plane device of claim 1 and in which a flexible eyelet means is secured to the front end of said body to which a towline may be attached.

3. The aquatic dive plane device according to claim 1 and in which said wing members are attached by their hinge means to said body on generally the same horizontal plane.

4. The aquatic dive plane device according to claim 1 and in which said wing members are positioned oliquely to a longitudinal front to rear center line of said body.

5. The aquatic dive plane device according to claim 1 and in which said wing members are affixed to the outer edges of said body such that said hinge means are formed of plastic material which returns said wing members to a neutral or horizontal position when released by the operator.

6. The aquatic dive plane device according to claim 3 and in which said wing members are positioned oliquely to a longitudinal front to rear center line of said body.

7. The aquatic dive plane device according to claim 6 and in which said wing members are affixed to the outer edges of said body such that said hinge means are formed of plastic material which returns said wing members to a neutral or horizontal position when released by the operator.

* * * * *